US006494561B1

(12) United States Patent
Yoshino

(10) Patent No.: US 6,494,561 B1
(45) Date of Patent: Dec. 17, 2002

(54) PRINTING APPARATUS AND METHOD FOR CONTROLLING THE SAME

(75) Inventor: Hiroshi Yoshino, Kawasaki (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 09/425,006

(22) Filed: Oct. 25, 1999

(30) Foreign Application Priority Data

Oct. 26, 1998 (JP) ..... 10-304528

(51) Int. Cl.[7] ..... B41J 2/165
(52) U.S. Cl. ..... 347/23
(58) Field of Search ..... 347/23, 32, 29, 347/30, 33, 101, 14, 19

(56) References Cited

U.S. PATENT DOCUMENTS 5,805,182 A * 9/1998 Lee ..... 347/35
5,831,644 A * 11/1998 Kato ..... 347/22
6,126,265 A * 10/2000 Childers et al. ..... 347/23
6,252,615 B1 * 6/2001 Yoshino ..... 347/36
6,328,414 B1 * 12/2001 Yoshino ..... 347/36

* cited by examiner

*Primary Examiner*—John Barlow
*Assistant Examiner*—Shih-Wen Hsieh
(74) *Attorney, Agent, or Firm*—Fitzpatrick, Cella, Harper & Scinto

(57) ABSTRACT

A printing apparatus free from the problem of vibration due to a head maintenance process when a recording head is maintained in the middle of a recording operation. The printing apparatus performs control so that a recording medium is conveyed subsequent to a head maintenance process, when the recording head is maintained in the middle of a recording operation. Even if the position of the recording medium suffers from an error due to the vibration of the apparatus in the course of the maintenance of the recording head, the error in the recording medium position is eliminated by conveying the recording medium in succession to the maintenance. A disturbance-free high-quality image is thus recorded on the recording medium.

22 Claims, 6 Drawing Sheets

PRINTING APPARATUS AND METHOD FOR CONTROLLING THE SAME

BACKGROUND OF THE INVENTION

1. Field of the Invention

The present invention relates to a control method for a printing apparatus that performs printing by moving a recording head in a direction perpendicular to the direction of conveyance of a copy sheet. More particularly, the present invention relates to a control method for a printing apparatus in a head maintenance operation to restore a recording state of a recording head in the middle of a recording operation.

2. Description of the Related Art

FIG. 3 shows one example of printing apparatus. The printing apparatus shown is a so-called serial printer, which performs printing by moving a recording head in a main scan direction in perpendicular to a direction of paper conveyance (i.e., a sub scan direction). The printing apparatus thus repeats the process of printing in the main scan direction and moving a recording medium in the sub scan direction. FIG. 4 is a sectional view of a major portion of the printing apparatus of FIG. 3. An automatic paper feeder 1 feeds a recording medium to a recording position where the recording head performs printing. Although the automatic paper feeder 1 usually stores a stack of recording media, only one of the recording medium is picked up by a paper feed roller 5 at one time and is supplied to a recording area 8 within a printing apparatus in operation. The recording medium 4, interposed between a pressure roller 6 and a paper conveyance roller 7, advances in an intermittent manner while a recording head (not shown) installed on a carriage 2 performs printing in the course of movement in a main scan direction (namely a direction in perpendicular to the direction of paper conveyance). A diversity of recording heads carry out different printing methods, and an ink-jet recording head, for example, has a portion with a plurality of discharge nozzles mounted therein. In operation, a head maintenance operation to be described later is carried out as necessary. The recording medium 4 that has undergone the printing is then discharged into a discharge tray 3.

The paper conveyance roller 7 rotates when supplied with drive power by a drive motor through a drive gear train (not shown). The pressure roller 6, in contact with the paper conveyance roller 7 or the recording medium 4, also rotates in combination therewith.

In the drive gear train, gears must be meshed with each other with a high degree of precision to accurately transfer the drive power of the drive motor. If the gears abut tightly each other with some load working therebetween, the gears may be damaged due to a mesh degradation and generate mechanical noise. To improve durability and increase low-noise performance, the gear train is typically provided with a backlash.

Specifically, a maintenance unit 9 for carrying out the above maintenance operation may be a suction unit for an ink jet head, a wiping unit for cleaning the face of the ink jet head (where discharge nozzles are arranged), an extra discharging unit for the ink jet head for discharging ink without printing, or some other similar unit. The maintenance unit 9 thus performs the function required to stabilize the printing operation of the ink jet head. Since such a maintenance unit is typically arranged outside the recording area, the maintenance operation is carried out after moving the recording head to the position of the maintenance unit. The maintenance operation typically involves moving the recording head, namely, the carriage 2, out of the recording area. The frequency of maintenance operations changes depending on the pattern to be printed in the printing operation (or a "print pattern") and environmental conditions such as temperature and humidity. To perform a high quality printing, the maintenance operation is performed several times during the printing of a single page.

Referring to FIG. 5, a sequence of the head maintenance process, in the middle of a printing operation, is discussed. The following example is a so-called single direction recording system in which an image is formed when the carriage 2 goes in the main scan and no image formation is carried out when the carriage 2 returns.

In the recording operation, the recording head discharges ink while the carriage 2 scans, and an image is formed on the recording medium 4 (step S501). The paper conveyance roller 7 rotates by a predetermined quantity of rotation to convey the copy sheet while the carriage 2 moves in its back scan direction (in the return direction), and the recording head is prepared to print a next line (step S502).

It is determined in step S503 whether the recording head needs maintaining. When it is determined that a head maintenance operation job is needed, the process goes to step S504 to execute a head maintenance operation. The process returns to step S501 as necessary subsequent to the head maintenance, and steps S501 through S504 are repeated.

When a head maintenance job is performed in the above conventional sequence, the carriage 2 is transferred to a maintenance position prior to the head maintenance operation. The range of scan in the head maintenance operation is different from that in a normal recording operation without performing the head maintenance job. In the head maintenance, the apparatus suffers from a vibration different from the vibration which is generated when the entire apparatus repeatedly scans in the normal printing operation. When a recording operation is executed in immediate succession to the execution of a head maintenance job, a printed image is subject to disturbance. The following causes of the disturbance are contemplated.

The entire apparatus vibrates due to the operation of a drive system that executes the head maintenance. Under such vibration, the paper conveyance roller 7 rotates by a small quantity of rotation corresponding to the backlash of the gear train, causing the recording head to be subject to a relative position error, and thereby leading to a landing error of an ink jet in the direction of paper conveyance. As a result, the printed image is disturbed. When the entire apparatus vibrates due to the operation of the drive system that executes the head maintenance, the vibration is transferred to the recording medium, causing it to vibrate, changing a distance to the recording head (i.e., the distance between the head and the copy sheet), and leading a landing error in the scan direction of the carriage 2 and a disturbance in the printed image.

SUMMARY OF THE INVENTION

In view of the above problem, the present invention has been developed. It is an object of the present invention to provide a printing apparatus and a control method for the printing apparatus, which outputs a good quality image by controlling a position error of a recording medium taking place in a head maintenance job in the middle of a printing operation and a vibration of the apparatus.

To resolve the above problem, the present invention provides a control method of a printing apparatus including a conveying unit for conveying a recording medium, a carriage with a recording head mounted thereon, and a maintenance unit for performing a maintenance job on the recording head, wherein the printing apparatus performs recording by intermittently operating the conveying unit to intermittently convey a recording medium by a predetermined travel and by causing the carriage to scan with the conveying unit stopped. When the recording head is maintained by the maintenance unit in the middle of the printing operation, the apparatus controls so that the operation of the conveying unit is stopped subsequent to the finish of a maintenance job.

A printing apparatus of the present invention includes a conveying unit for conveying a recording medium, a carriage with a recording head mounted thereon, and a maintenance unit for performing a maintenance job on the recording head, wherein the printing apparatus performs recording by intermittently operating the conveying unit to intermittently convey a recording medium by a predetermined travel and by causing the carriage to scan with the conveying unit stopped. The printing apparatus includes a control unit for performing control so that the operation of the conveying unit is stopped subsequent to the finish of a maintenance job when the recording head is maintained by the maintenance unit in the printing operation.

In accordance with the present invention, when the maintenance of the recording head becomes necessary in the middle of printing operation to the recording medium, the conveying unit is controlled so that the conveying unit is operated subsequent to the maintenance job. Even if the apparatus suffers from a vibration in the course of the maintenance of the recording head, the entire apparatus is set to a normal printing state, namely, a state as if no maintenance job were done, before the apparatus resumes a printing operation. The image disturbance due to the vibration of the apparatus is thus prevented. Even if the recording medium is in position error due to the vibration subsequent to the maintenance, the error of the recording medium is covered because the conveying unit has operated subsequent to the maintenance.

DESCRIPTION OF THE PREFERRED EMBODIMENTS

Figure 1:
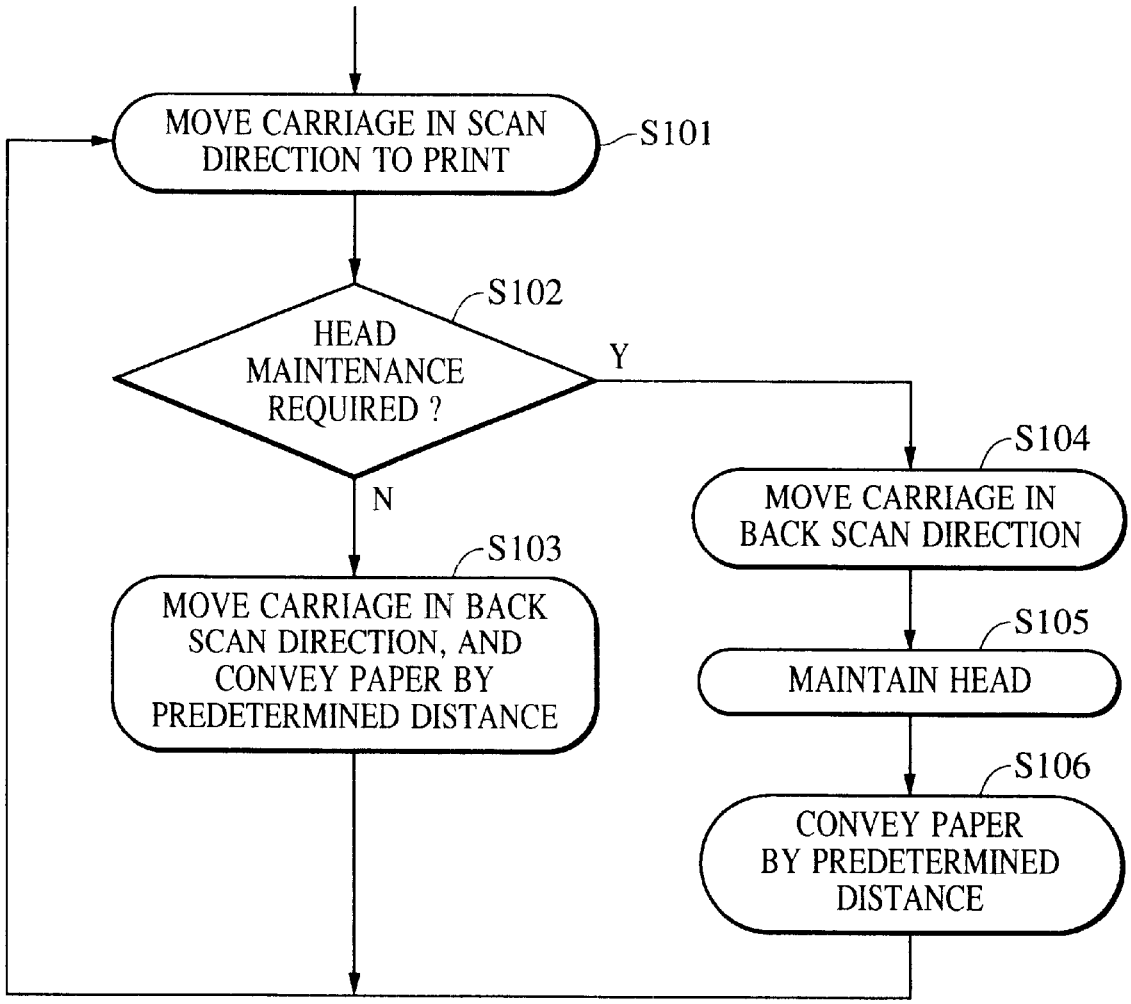
FIG. 1 is a flow diagram of the operation of a printing apparatus which executes a head maintenance job in the middle of a printing operation in accordance with a first embodiment of the present invention.

Throughout the description of this invention, the term "recording" refers to transferring not only an image of texts and drawings, which have themselves meaning, but a pattern, which itself is meaningless. The terms "recording" and "printing" are interchangeably used in this specification.

The present invention applies to a variety of apparatuses which perform recording onto printing media including sheets of paper, threads, fibers, fabric, hides, metals, plastics, glass, wood, ceramics, etc. These apparatuses include printers, copying apparatuses, facsimiles having a communication system, a printer system in which a communication system and a printer are combined, an apparatus, such as a word processor, with a printer section, and an industrial recording apparatus in which a diversity of processing devices are combined.

The printing apparatus and the control method for the printing apparatus of the present invention are now discussed, referring to the drawings.

First Embodiment

Figure 3:
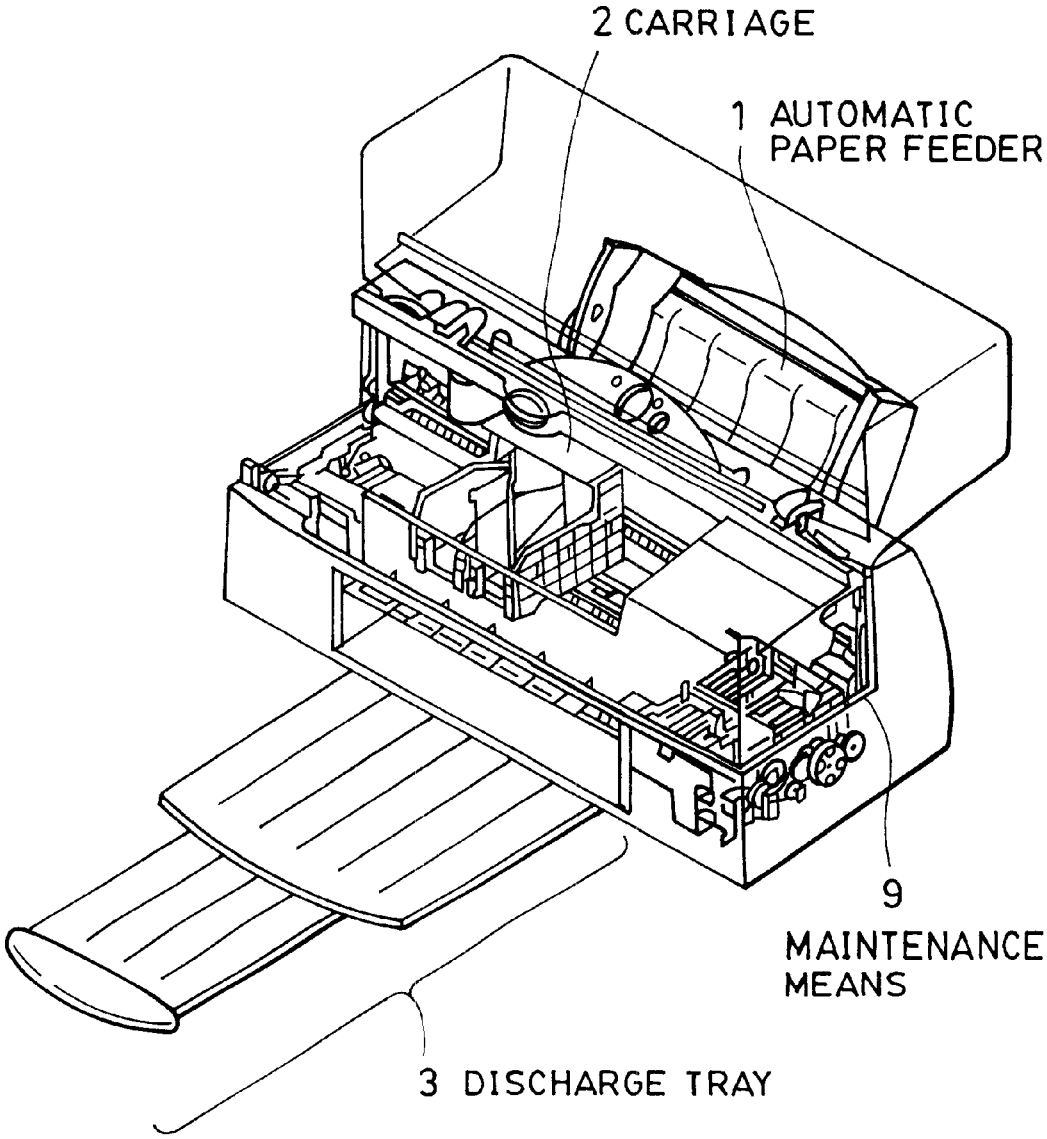
FIG. 3 is a perspective view of a printing apparatus of the present invention.
Figure 4:
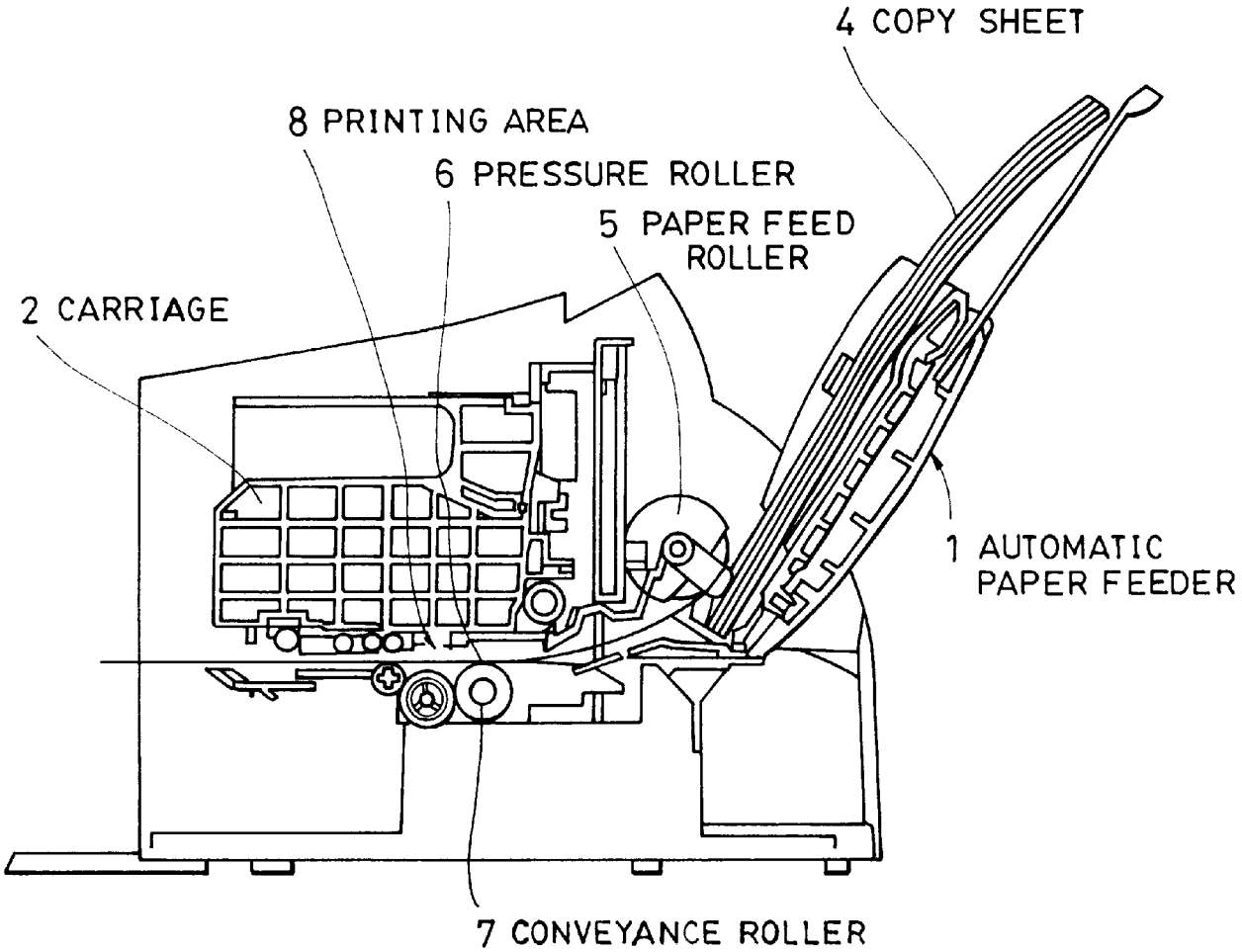
FIG. 4 is a sectional view of the printing apparatus.
Figure 5:
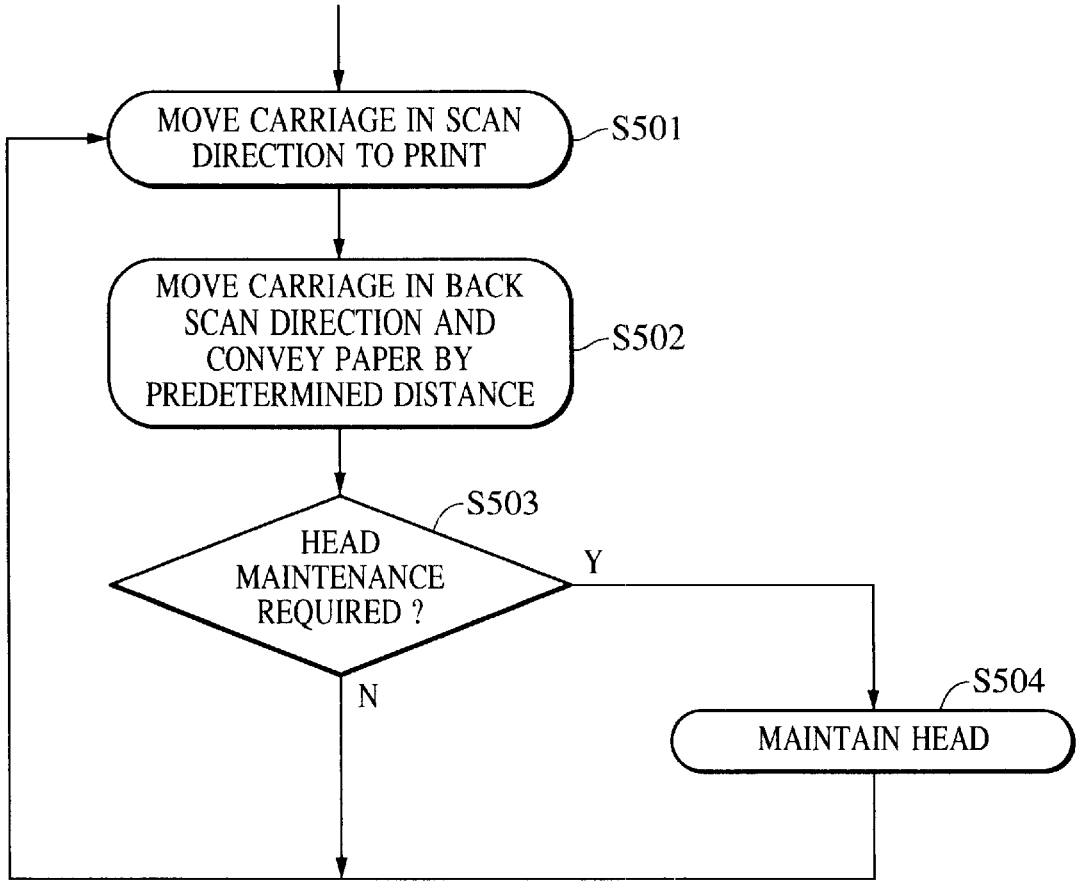
FIG. 5 is a flow diagram of the operation of a conventional printing apparatus which executes a head maintenance job in the middle of a printing operation.

The construction of a recording apparatus, in which the present invention is implemented, remains unchanged from that discussed in conjunction with the conventional art shown in FIG. 3 and FIG. 4. The recording apparatus of a first embodiment of the present invention is the one that records an image onto a recording medium using an ink-jet type recording head for discharging ink (also called an ink-jet head).

A variety of known techniques may be employed as an ink discharging method. For example, the present invention may employ a bubble jet technique which discharges ink by applying thermal energy with an electricity-heat converting body such as a heater element as an means for discharging ink, or a technique which employs an element, such as an piezoelectric element, which generates mechanical pressure by applying an electrical signal thereto.

As already discussed, available as a maintenance unit 9 for carrying out the above maintenance operation may be a suction unit for an ink jet head, a wiping unit for cleaning the face of the ink jet head (where discharge nozzles are arranged), an extra discharging unit for the ink jet head for discharging ink without printing, or some other similar unit. The head maintenance unit is the one for restoring a full discharging capability of the ink-jet head, and may be referred to as a "restoring unit".

The suction unit may include a cap member for covering a discharge nozzle face of the recording head, a mechanism for generating a negative pressure within the cap member using a pump or the like, and a drive mechanism for moving the cap member to the discharge nozzle face of the recording head. In the operation of the suction unit, the carriage 2 having an ink-jet head mounted thereto is transferred to the position of the head maintenance unit. The discharge nozzle face is capped with the cap member by moving the cap member to the discharge nozzle face. A negative pressure is then generated within the cap member.

The wiping unit may include a wiping member for wiping the recording head. The carriage 2 having the ink-jet head mounted thereon scans with respect to the wiping member to wipe its discharge nozzle face.

The head maintenance operation in accordance with the present invention may incorporate the above techniques, alone or in combination.

Figure 6:
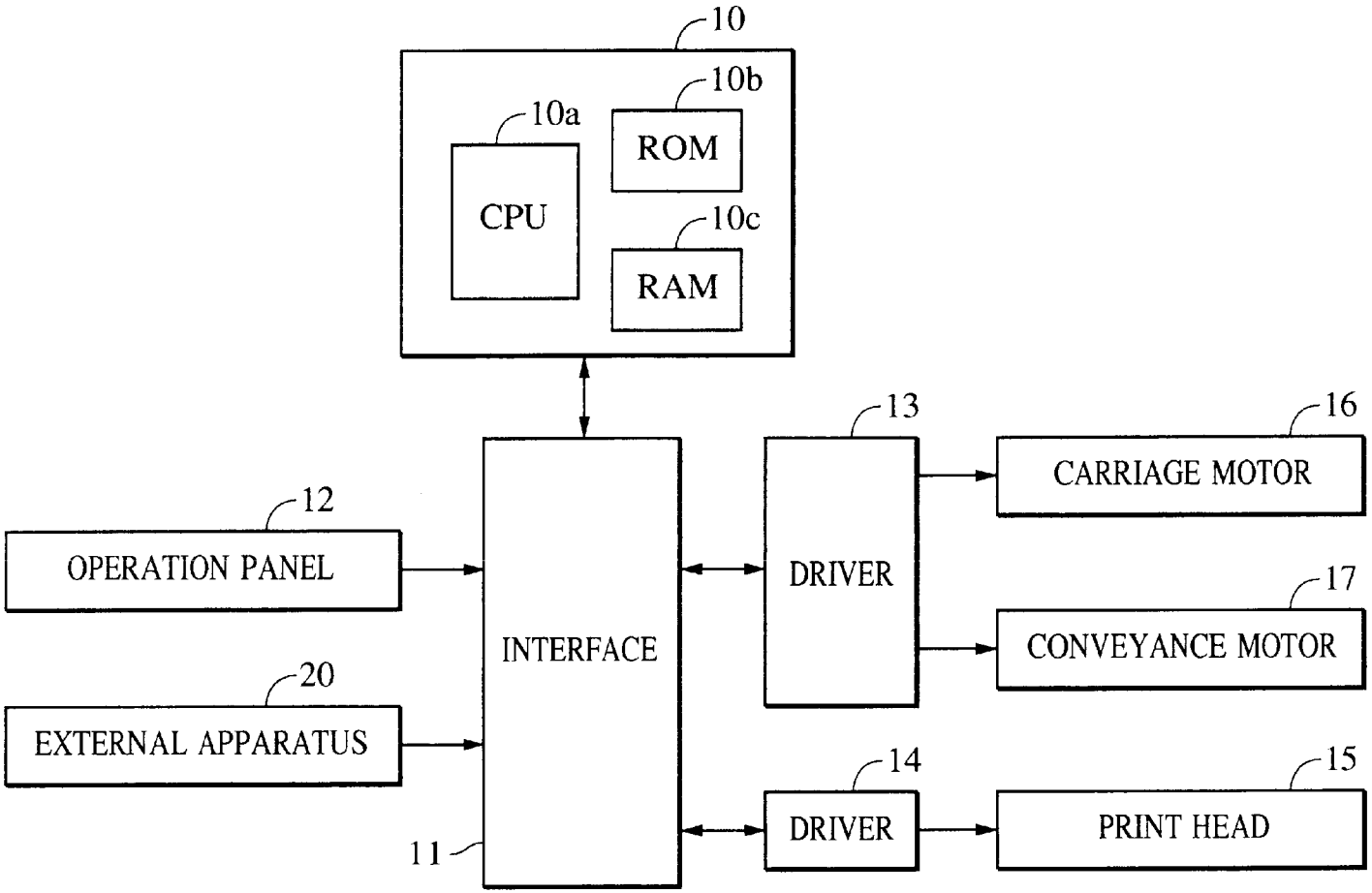
FIG. 6 is a block diagram showing a control system of an ink jet printing apparatus in which the present invention is implemented.

FIG. 6 is a block diagram roughly showing a control system of an ink-jet recording apparatus, in which the present invention is implemented.

The control system shown in FIG. 6 drives and controls each block in the recording apparatus. A control unit 10 includes CPU 10*a* that executes a process for controlling each block, ROM 10*b* for storing a program and the like to be executed by CPU 10*a*, and RAM 10*c* for storing a diversity of data.

CPU 10*a* may be a central processing unit, for example, and reads the program and diverse data from ROM 10*b* to be described later, and an external apparatus 20, such as a host apparatus, performs necessary computations and determinations, and controls each block in the printing apparatus.

ROM 10*b* is a read-only memory, and stores the program to be executed by CPU 10*a*, and a diversity of data needed to control the recording apparatus and to perform recording on the recording apparatus, such as character codes and dot patterns.

RAM 10*c* is a memory to and from which data is written or read (also referred to as a "read-write memory"), and is constructed of a working area for temporarily storing data currently under processing and computation results, a buffer area for storing a diversity of data input from the external apparatus 20, and a text area for storing text and the like.

The control unit 10 receives an image signal from the external apparatus 20 through an interface 11, and diverse pieces of information from an operation panel 12, including those about a recording density, the number of copies, and the size of copying area. The control unit 10 outputs a drive signal to a motor driver 13 which controls and drives motors. The control unit 10 further outputs an image signal and the like to a head driver 14 that controls and drives a recording head 15. The motors driven by the motor driver 13 are a carriage motor 16 for moving the carriage 2 and a conveyance motor 17 for conveying a recording medium.

One example of the control sequence of the printing apparatus of the present invention is now discussed, referring to FIG. 1.

FIG. 1 illustrates the operational flow of the head maintenance that is carried out in the middle of a recording operation.

Step S101 is a processing step for recording. In the recording operation, the recording head is driven in response to the image signal with the carriage 2 moved in the scan direction, and an image is formed on the recording medium 4. The recording head in the embodiments of the present invention is an ink-jet type recording head. With the recording head driven, ink is discharged through nozzles arranged on the recording head.

In step S101, the carriage 2 scans in a predetermined direction. It is determined in step S102 whether a head maintenance job needs to be carried. When it is determined in step S102 that the recording head needs maintaining, the process goes to step S104.

In step S104, the carriage 2 is moved to a predetermined position in a return direction (hereinafter referred to as a "back scan direction") with a conveyance roller 7 as means for conveying the recording medium 4 not rotated. The head maintenance (in step S105) and the conveying of the recording medium by a predetermined distance by the conveying unit (in step S106) are executed.

When it is determined in step S102 that the recording head needs no maintenance, the process goes to step S103. In step S103, the paper conveyance roller 7 is rotated by a predetermined quantity of rotation to convey the recording medium 4 by a required distance while the carriage 2 scans in the return direction. When the back scan of the carriage 2 and the conveyance of the recording medium 4 are completed, the process returns to step S101 and the recording operation is resumed. Steps S101 through S106 are hereinafter repeated.

The above sequence is executed by the control system in the above-referenced printing apparatus.

Since the recording medium 4 is conveyed by the paper conveyance roller 7 subsequent to the head maintenance, the position of the recording medium 4, if deviated due to the vibration of the apparatus during the head maintenance, is corrected. Since the mode of vibration of the entire apparatus immediately prior to the resuming of the recording becomes the normal mode of vibration, no image disturbance takes place even subsequent to the head maintenance in the middle of the recording operation.

The present invention is effective particularly in an arrangement, such as the above-referenced suction unit or wiping unit, involving a mechanical operation, i.e., the movement of the cap member or the generation of the negative pressure or in an arrangement involving the movement of the carriage 2 different from its movement for the recording.

The temperature of the recording head, the ambient temperature, the number of drivings of the recording head, the amount of recording about a recorded area serve alone or in combination as a criterion in the determination in step S102 of whether the head maintenance is required. Alternatively, known techniques relating to the timing for carrying out the restoring operation of the recording head may be used.

In the flow diagram shown in FIG. 1, a determination of whether the recording head needs maintaining is performed each time the carriage 2 scans for printing. The present invention is not limited to this method. Alternatively, a determination of whether the recording head needs maintaining is performed every predetermined number of scans of the recording head. Alternatively, a determination of whether the recording head needs maintaining may be performed referring to the number of recorded dots or detected temperature in the middle of the printing by the recording head.

Second Embodiment

A second embodiment is now discussed, referring to the drawings.

Figure 2:
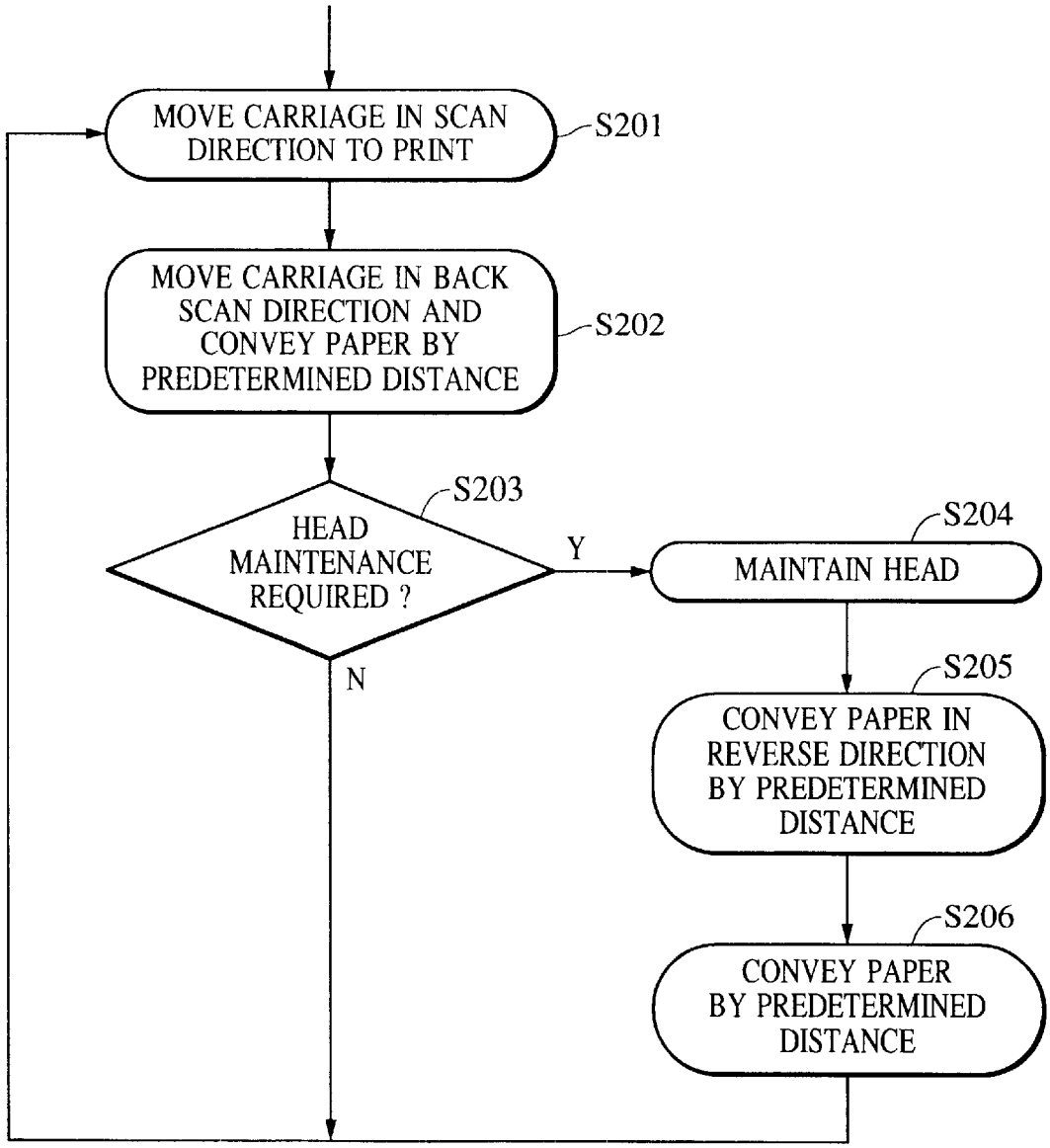
FIG. 2 is a flow diagram of the operation of a printing apparatus which executes a head maintenance job in the middle of a printing operation in accordance with a second embodiment of the present invention.

FIG. 2 is a flow diagram showing the head maintenance process in the middle of the recording operation. Each of this process is now discussed.

Step S201 is a processing step for recording. In the same way as in the first embodiment, the recording head is driven for printing while the carriage 2 scans. In step S202, the carriage 2 scans in the return direction, while the paper conveyance roller 7 is rotated by a predetermined quantity of rotation to convey the recording medium 4. Through the process in step S202, the next line succeeding to the line that has undergone the printing is ready for next printing. In step S203, a determination is performed of whether the recording head needs maintaining. When it is determined in step S203 that the recording heads needs maintaining, the process goes to step S204.

In step S204, the head maintenance process is performed. In step S205, the paper conveyance roller 7 is rotated by the predetermined quantity of rotation in a reverse direction, and is then rotated again by the predetermined quantity of rotation in the paper conveyance direction (step S206). The process then returns to step S201 and the recording operation is resumed.

The rotation of the paper conveyance roller 7 in step S205 is opposite in direction to the paper conveyance direction. Through the rotations of the paper conveyance roller 7 in step S205 and step S206, the paper conveyance roller 7 is stopped at the same position as if no head maintenance took place. Even if the gear train rotates in response to the vibration of the apparatus due to the head maintenance process, the relative position of the recording medium 4 with respect to the recording head is set to be back to its original one.

When it is determined in step S203 that no head maintenance is required, the process returns to step S201, and the recording is resumed.

Steps in S201 through S206 are repeated, and the recording operation is performed.

The sequence in the second embodiment is performed by the control system in the printing apparatus in the same way as in the first embodiment.

The same factors as those in the first embodiment are accounted for as the criteria of the determination of whether the recording head needs maintaining. The same timing for the determination of whether the recording head needs maintaining, discussed in conjunction with the first embodiment, is also applicable.

In accordance with the present invention, the paper conveyance roller 7 is rotated by a predetermined quantity of rotation in a direction reverse to the paper conveyance direction, subsequent to the head maintenance, and is then rotated by the predetermined quantity of rotation in the paper conveyance direction. Through this process, the paper conveyance roller 7 and the gear train for driving the paper conveyance roller 7 are set back to the same state as if no head maintenance job were made. Even if the apparatus vibrates in the head maintenance process and suffers from a mechanical position error, possibly leading to an image disturbance, such a image disturbance due to the head maintenance job in the middle of the recording operation is controlled.

Even if the head maintenance is carried out in the middle of the recording operation, the conveying unit for conveying the recording medium is activated to eliminate the effect caused in the head maintenance, and the image quality is maintained.

What is claimed is:

1. A control method of a printing apparatus comprising conveying means for conveying a recording medium, a carriage with a recording head mounted thereon, and maintenance means for maintaining said recording head, said printing apparatus performing recording by intermittently operating said conveying means to intermittently convey said recording medium by a predetermined distance and by causing said carriage to scan with said conveying means stopped, said method comprising the steps of:

determining, in the middle of a recording operation to said recording medium, whether said recording head needs maintaining;

performing maintenance control by stopping the operation of said conveying means during the maintenance job carried out by said maintenance means, when the recording head is maintained in the middle of the recording operation in accordance with the result of said determining step, and then conveying said recording medium by said predetermined distance subsequent to the maintenance of said recording head, when the recording head is maintained; and conveying said recording medium after performing said maintenance job and then performing the recording operation by scanning the recording head.

2. A control method according to claim 1, wherein in said maintenance control step, said recording medium is conveyed in a direction reverse to the direction of conveyance of said recording medium by said predetermined distance subsequent to the maintenance of said recording head and is then conveyed in the direction of conveyance by said predetermined distance, when the recording head is maintained.

3. A control method according to claim 1, wherein said recording head is an ink-jet head, and wherein said maintenance means maintains said recording head by sucking ink through a discharge nozzle of said recording head, thereby restoring a discharging state of said recording head.

4. A control method according to claim 1, wherein said recording head is an ink-jet head, and wherein said maintenance means maintains said recording head by wiping a portion of a discharge nozzle of said recording head.

5. A control method according to claim 1, wherein said recording head is an ink-jet head, and wherein the maintenance of said recording head is an extra discharging operation in which ink is discharged through said recording head in a mode not for recording.

6. A control method according to claim 1, wherein said conveying means comprises a recording medium conveyance roller.

7. A control method according to claim 1, wherein said recording head is an ink-jet head for discharging ink through a discharge nozzle, having discharging means for discharging ink.

8. A control method according to claim 7, wherein said discharging means is an electricity-heat converting body applying thermal energy to ink.

9. A printing apparatus having conveying means for conveying a recording medium, and a carriage with a recording head mounted thereon, said printing apparatus performing recording by intermittently operating said conveying means to intermittently convey said recording medium by a predetermined distance and by causing said carriage to scan with said conveying means stopped, said printing apparatus comprising:

maintenance means for maintaining said recording head; and control means for performing control by stopping the operation of said conveying means during the maintenance job carried out by said maintenance means, when said recording head is maintained by said maintenance means in the middle of the recording operation on said recording medium, then conveying said recording medium by a predetermined distance subsequent to the maintenance of said recording head by said maintenance means, when the recording head is maintained in the middle of the recording operation on said recording medium, and, after conveying said recording medium by said conveying means, performing the recording operation by scanning said carriage.

10. A printing apparatus according to claim 9, wherein said control means performs control so that said recording medium is conveyed in a direction reverse to the direction of conveyance of said recording medium by a predetermined distance, subsequent to the maintenance of said recording head by said maintenance means, and is then conveyed in the direction of conveyance by said predetermined distance.

11. A printing apparatus according to claim 9, wherein said recording head is an ink-jet head, for discharging ink through a discharge nozzle, comprising discharging means for discharging ink.

12. A printing apparatus according to claim 11, wherein said maintenance means is sucking means which sucks ink through said discharge nozzle of said recording head to restore a discharging state.

13. A printing apparatus according to claim 11, wherein said maintenance means is wiping means for wiping a mounting portion of a discharge nozzle of said recording head.

14. A printing apparatus according to claim 11, wherein said maintenance means is extra discharging means for discharging ink through said recording head in a mode not for recording.

15. A printing apparatus according to claim 11, wherein said discharging means is an electricity-heat converting body applying thermal energy to ink.

16. A printing apparatus according to claim 9, wherein said conveying means is a conveyance roller for conveying said recording medium.

17. A control method of a printing apparatus having conveying means for conveying a recording medium, a carriage with a recording head mounted thereon, scanning means for causing said carriage to scan in a direction perpendicular to the direction of conveyance of said recording medium by said conveying means, and maintenance means for maintaining said recording head, said printing apparatus performing recording onto said recording medium by repeating an operation of conveying said recording medium by a predetermined distance with said conveying means, and a scanning operation of said carriage by said scanning means along with a recording operation by said recording head, said control method comprising the steps of:

determining, at a predetermined timing in the middle of recording onto said recording medium, whether to maintain said recording head with said maintenance means; and performing maintenance control so that, when the maintenance of said recording head is determined to be needed, said scanning means causes said recording head to scan to the position of said maintenance means, subsequent to the scanning of said carriage with said recording head performing recording, said maintenance means maintains said recording head, and then said conveying means conveys said recording medium by a predetermined distance.

18. A control method according to claim 17, wherein said recording head is an ink-jet head, for discharging ink through a discharge nozzle, having discharging means for discharging ink.

19. A control method according to claim 18, wherein said discharging means is an electricity-heat converting body applying thermal energy to ink.

20. A printing apparatus having conveying means for conveying a recording medium, a carriage with a recording head mounted thereon, scanning means for causing said carriage to scan in a direction perpendicular to the direction of conveyance of said recording medium by said conveying means, and maintenance means for maintaining said recording head, said printing apparatus performing recording by intermittently operating said conveying means to convey said recording medium by a predetermined distance and by causing said carriage to scan with said conveying means stopped, said printing apparatus comprising:

recording control means for performing recording onto said recording medium by repeating an operation of conveying said recording medium by a predetermined distance with said conveying means, and a scanning operation of said carriage by said scanning means along with a recording operation by said recording head;

determining means for determining at a predetermined timing in the middle of recording onto said recording medium whether to maintain said recording head; and maintenance control means for performing maintenance control so that, when said determining means has determined that the maintenance of said recording head is needed, said scanning means causes said recording head to scan to the position of said maintenance means, subsequent to the scanning of said carriage with said recording head performing recording, said maintenance means maintains said recording head, and then said conveying means conveys said recording medium by a predetermined distance.

21. A printing apparatus according to claim 20, wherein said recording head is an ink-jet head for discharging ink through a discharge nozzle, having discharging means for discharging ink.

22. A printing apparatus according to claim 21, wherein said discharging means is an electricity-heat converting body applying thermal energy to ink.

* * * * *

UNITED STATES PATENT AND TRADEMARK OFFICE

CERTIFICATE OF CORRECTION

PATENT NO. : 6,494,561 B1
DATED : December 17, 2002
INVENTOR(S) : Yoshino

It is certified that error appears in the above-identified patent and that said Letters Patent is hereby corrected as shown below:

Column 1,
Line 18, “in perpendicular” should read -- perpendicularly --; and
Line 34, “in” should be deleted.

Column 2,
Line 25, “subsequent” should read -- subsequently --.

Column 3,
Lines 11, 23, 30 and 39, “subsequent” should read -- subsequently --.

Column 6,
Line 37, “Each” should read -- Each step --; and
Line 49, “needs” should read -- need --.

Column 7,
Line 24, “a” should read -- an --; and
Lines 51 and 62, “subsequent” should read -- subsequently --.

Column 8,
Lines 38 and 49, “subsequent” should read -- subsequently --.

Signed and Sealed this

Twenty-eighth Day of October, 2003

JAMES E. ROGAN
*Director of the United States Patent and Trademark Office*